US005137154A

United States Patent [19]

Cohen

[11] Patent Number: 5,137,154

[45] Date of Patent: Aug. 11, 1992

[54] FOOD BAG STRUCTURE HAVING PRESSURIZED COMPARTMENTS

[75] Inventor: Edwin Cohen, Binghamton, N.Y.

[73] Assignee: Douglas M. Clarkson, Binghamton, N.Y. ; a part interest

[21] Appl. No.: 783,807

[22] Filed: Oct. 29, 1991

[51] Int. Cl.[5] ..... B65D 30/22; B65D 33/02; B65D 33/04; B65D 85/30

[52] U.S. Cl. ..... 206/522; 383/3; 383/38; 383/119; 426/106; 426/414

[58] Field of Search ..... 383/3, 119, 38, 40, 383/104; 206/522; 426/112, 410, 106, 414

[56] References Cited

U.S. PATENT DOCUMENTS

| | | | |
|---|---|---|---|
| 2,835,596 | 5/1958 | Kaufman | 206/522 |
| 3,008,835 | 11/1961 | Madding | 383/38 |
| 3,016,806 | 1/1962 | Schoen et al. | 383/38 |
| 3,191,849 | 6/1965 | Gutowski et al. | 383/119 |
| 4,164,970 | 8/1979 | Jordan | 206/522 |
| 4,384,603 | 5/1983 | Tyrer et al. | 383/3 |
| 4,898,280 | 2/1990 | Runge | 383/905 |

*Primary Examiner*—Stephen P. Garbe
*Attorney, Agent, or Firm*—Douglas M. Clarkson

[57] ABSTRACT

A structure for a food bag that is suitable for a larger than usual sized bag is described as being formed of two sections of a flexible material. The two sections of flexible material are arranged one over the other and sealed around their periphery. Another sealing line is located along at least one side spaced from the one periphery line to form an elongated stiffening compartment when filled with a suitable gas, such as air, under pressure. The remaining space between the sealed sections forms a food compartment that is maintained in an erect, upright position by the elongated stiffening compartment.

12 Claims, 1 Drawing Sheet

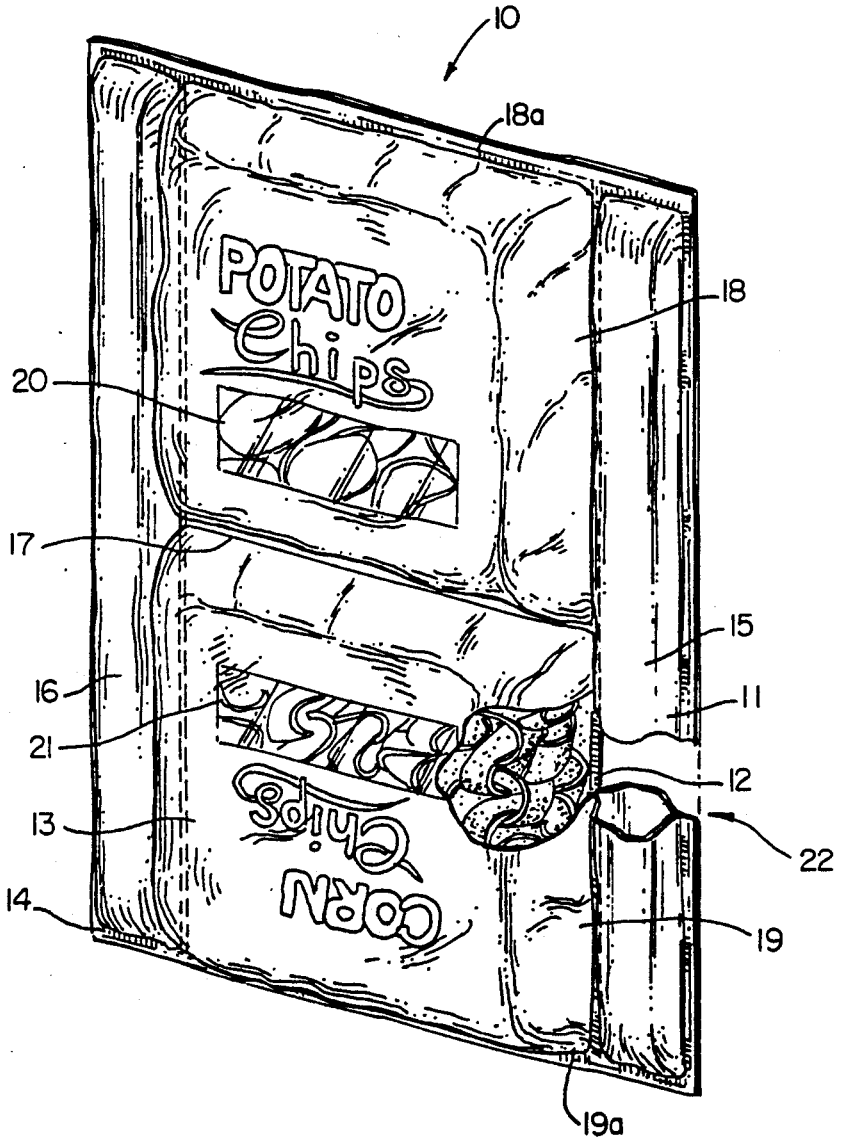
10
18a
POTATO
Chips
18
20
17
15
16
11
21
12
13
22
CORN
Chips
14
19
19a

FOOD BAG STRUCTURE HAVING PRESSURIZED COMPARTMENTS

BACKGROUND OF THE INVENTION

FIELD OF THE INVENTION

The present invention, generally, relates to packages for food and, more particularly, to a new and improved structural arrangement for a package to enclose food that is somewhat more fragile than most, such food to be enclosed in a package that is somewhat larger in its size than most.

An example of the type of food that a bag, constructed in accordance with the present invention, is uniquely adapted to enclose safely is potato chips and the like. As it will be seen, however, the food bag of the invention can enclose a variety of other types of food. To simplify the description to follow, therefore, potato chips and the like will be used to illustrate the invention.

When potato chips are packaged in larger bags, for marketing purposes, chips at the bottom become broken from the sheer weight of those above, and the entire bag loses a lot of its appeal to a purchaser. Several potato chip manufacturers, as a consequence, no longer offer potato chips in an "economy" size, because the cans that were used in the past are no longer feasible economically.

There is still another disadvantage in packaging potato chips in a larger sized bag. Such a quantity of potato chips are more likely to produce "left overs", because they are not all eaten at one time, except of course, the legendary "couch potato" who customarily consumes the entire bag once it is opened and available.

Nevertheless, it remains a distinct marketing advantage in today's frantic economy to offer potato chips in larger sized bags. To overcome the disadvantages described above, enterprising marketing individuals have developed the scheme of clipping two smaller bags together. Sales of this form of packaging have demonstrated the merits of offering larger quantities of potato chips over smaller, or so called "individual " sizes.

While some of these prior marketing efforts may at first appearance have similarities with the arrangement of the present invention, they differ in material respects. These differences, which will be more evident as the description proceeds, are essential for the effective use of a package arranged and structured in accordance with the present invention. Also, a food bag structure in accordance with the principles of the invention admits of advantages that are not available in prior food package arrangements.

OBJECTS AND SUMMARY OF THE INVENTION

Accordingly, it is an important object of the invention to provide a new and unique structure for food packaging that ameliorates the disadvantages described above.

Another object of the present invention is to provide a structural arrangement for food packaging of fragile items that tends to protect a quantity of the items while access is available to a portion of the items.

Still another object of the invention is to provide a new and improved form of packaging for fragile food items that overcomes the disadvantages identified above while not increasing the cost of the package appreciably.

Briefly, a food package sructure that is arranged according to the principles of the present invention has two compartments positioned in a predetermined relationship with each other. One of the compartments is formed to enclose a selected food item in a sealed condition, and the other compartment, being a slender, elongated compartment forms a bladder which, when filled with a predetermined gas and pressurized, maintains the food compartment in a predetermined position.

A more specific characterization of a package structure according to the invention embodies two food compartments formed of a suitable plastic material , and the material is arranged in a selected configuration and sealed across an intermediate line, thereby dividing the package into the two compartments.

In addition, the plastic material is sealed along at least one additional line that is spaced from a first sealed line to form a bladder space which maintains the relationship of the two compartments relative to each other when stiffened by inflating with a gas and pressurized.

The above and other objects, advantages and features of the present invention will become more apparent from the following detailed description of the presently preferred embodiments as illustrated in the accompanying drawings.

BRIEF DESCRIPTION OF THE DRAWINGS

The single figure of drawings shown in perspective a food bag with two compartments stiffened and held in their position relative to each other by two bladder spaces, one on each side.

DETAILED DESCRIPTION OF THE INVENTION

As illustrated in the drawing, the food bag of the invention is identified generally by the reference numeral 10. The bag 10 if formed of any suitable material, but most often a plastic material is selected, either a single sheet that is folded back over itself along one edge to form two sections or two separate sheets overlapping.

The two sheets are sealed along lines indicated by the numerals 11, 12, 13 and 14 to form two slender, elongated, stiffening compartments 15 and 16, and a seal line 17 divides the food bag 10 into two food compartments 18 and 19. It is important that, when two food compartments are to be formed, the seal line 17 extend only between the two seal lines 12 and 13 so that the two elongated, stiffening compartments 15 and 16 are uninterrupted along their length.

The material of which the food bag 10 is formed may be transparent so that the contents are visible throughout the extent of both food compartments 18 and 19. However, if an opaque material is selected, it is contemplated that a window, illustrated by the numerals 20 and 21, will reveal visually the contents of each food compartment 18 and 19.

A window, of course, does not add structurally to the package of the invention, but it is a most effective marketing feature. This is true also of any lettering or words that can be included to assist a marketing effort.

The elongated, stiffening compartment 15 is shown in the drawing in a cut away section 22 to illustrate that it is hollow along its inner length. The slender, elongated, stiffening compartment 16 is constructed like the compartment 15.

While both of these elongated, stiffening compartments will enclose a preselected element to perform the "stiffening" feature in accordance with the invention, it is presently preferred that each compartment 15 and 16 be filled with an appropriate gas, such as air, under a pressure that is sufficient to maintain the food bag structure erect and in the desired position.

By this arrangement and with the two elongated, stiffening compartments 15 and 16 filled with air under sufficient pressure to maintain the package 10 in the position shown in the drawing, the contents of the two food compartments 18 and 19 will be supported and, thus, maintained in the relative positions shown.

It is to be understood that the preferred use of a bag that is arranged according to the invention is to enclose the same food in both of the food compartments 18 and 19. However, it is a possible use of a bag structure according to the invention that a different food could be enclosed in one food compartment from that in the second compartment.

This is illustrated in the drawing by the "potato chips" and the "corn chips" legends. With food enclosed in the food compartments, the package of the invention can be cut along the seal line 17 after purchase, so that both food compartments then are accessible for opening, because all of the lines are broad enough for that purpose.

With the same food in both compartments, the package 10 cannot be inverted inadvertently on the grocery shelf, because the legends on the two food compartments are reversed relative to each other, also as illustrated in the drawing. This adds value to the package since a manufacturer's logo and/or identity could not be inverted even accidently by up ending a bag on a grocery shelf.

Also, when the same food is enclosed in both of the compartments, the food in the second compartment will remain sealed and, therefore, fresher after the first compartment is opened for access. Still another advantage that is available with a larger sized bag according to the invention is that the package has a larger appearance, and legitimately so, because empty spaces are kept to a minimum.

Even though a bag constructed according to the present invention can readily enclose as many potato chips as a previous "tin" can, it does so with all of the advantages and customer appeal of today's smaller potato chip bag. It is logical to extend the presently described two compartment bag structure to one that has a plurality of compartments, such as three or even four, or more.

The two elongated, stiffening compartments that extend over substantially the height of the bag structure maintains the respective food compartments, regardless of the number, in their prearranged relationship relative to each other. The two elongated, stiffening compartments function effectively as pressurized bladders that stiffen the entire package so that a tendency to bend about the intermediate seam, such as the line 17, is eliminated almost entirely.

Still further, after both food compartments are emptied of their contents, the pressurized bladders 15 and 16 can be punctured to release the air, or other gas, so that the package 10 then will lie flat for disposal more readily.

With a larger sized food bag arranged as described, the respective food compartments can be readily pressurized also, using the same gas as that used in the elongated, stiffening compartments, i.e., air, or it can be a different gas, one with a food preserving effect or capability. Once the food compartment 18 is filled with a selected food and, if desired, a gas for preserving the food or just for pressurizing the compartment, it is sealed along line 18*a*. Similarly, line 19*a* seals food compartment 19.

As described initially hereinabove, a larger sized food bag that is arranged according to the invention can involve a single food compartment, and such food compartment may have a single elongated, stiffening compartment which, when filled with a gas under pressure, will maintain the food compartment in an erect, upright position.

While the invention has been illustrated and described with reference to a presently preferred embodiment, it is understood that one skilled in this art having the foregoing description before him will be able to make modifications and changes, but it is understood also that the present invention is not limited to the described embodiment, but rather, the invention is limited only by the scope of the claims appended hereto.

What is claimed is:

1. A food bag structure for enclosing a predetermined frangible food, comprising:

a single sheet of a predetermined flexible material folded to form two sections, one section positioned over the other and defining outer periphery edges;

means sealing said two sections together around said outer periphery edges;

means sealing said two sections together along a line spaced a predetermined distance from one edge of said outer periphery edges and extending a predetermined distance to define a first compartment for enclosing food and a second, elongated stiffening compartment; and said second, elongated stiffening compartment containing a preselected gas under a predetermined pressure;

so that said first compartment is defined between said sections for enclosing a preselected frangible food, and said elongated stiffening compartment containing said gas under pressure maintains said food compartment in a predetermined position.

2. A food bag structure as defined by claim 1 including means sealing said two sections together along a second line spaced a predetermined distance from a second edge of said periphery to define a second elongated stiffening compartment.

3. A food bag structure as defined by claim 2 including means sealing said two sections together along a line from said first mentioned elongated stiffening compartment to said second elongated stiffening compartment to form two food compartments.

4. A food bag structure as defined by claim 3 wherein each of said means sealing said two sections together is formed to permit cutting for separting a food compartment from said food bag structure while maintaining a seal on the other of said two food compartments.

5. A food bag structure as defined by claim 4 wherein said predetermined flexible material is an opaque plastic.

6. a food bag structure as defined by claim 5 wherein said food compartments are pressurized with a predetermined gas.

7. A food bag structure as defined by claim 6 wherein said elongated stiffening compartments are pressurized with air.

8. A food bag structure as defined by claim 1 wherein each of said means sealing said two sections together is sufficiently wide to permit a cut to separate said compartments while maintaining said first and second compartments sealed.

9. A food bag structure as defined by claim 1 wherein said predetermined flexible material is an opaque plastic having at least a portion clear to permit the contents of said food compartment of be viewed.

10. A food bag structure as defined by claim 1 wherein said predetermined flexible material is clear plastic.

11. A food bag structure as defined by claim 1 wherein said predetermined flexible material is an opaque plastic with a window portion of clear material to permit a food in said food compartment to be viewed.

12. A food bag structure for enclosing a predetermined frangible food, comprising:

two sheets of a flexible material with predetermined length and width, said length being longer than said width, one sheet positioned over the other and defining outer periphery edges;

means sealing said two sheets together long said outer periphery edges;

means sealing said two sheets together along a line spaced a predetermined distance from a preselected edge of said outer periphery edges, and extending substantially said length of said sheets to define a first, larger food compartment and a second, smaller elongated stiffening compartment; and said elongated stiffening compartment containing a preselected gas under pressure to provide a predetermined stiffness to said food compartment;

so that a stiffened food compartment is formed to enclose a preselected frangible food, and said elongated stiffening compartment containing said gas maintains said food compartment in a predetermined position.

* * * * *